US011096863B2

(12) United States Patent
Kajihara et al.

(10) Patent No.: US 11,096,863 B2
(45) Date of Patent: Aug. 24, 2021

(54) PORT, AND MEDICAL LIQUID BAG

(71) Applicants: Otsuka Pharmaceutical Factory, Inc., Tokushima (JP); Otsuka Techno Corporation, Tokushima (JP)

(72) Inventors: Yasuyuki Kajihara, Tokushima (JP); Hidenari Shoji, Tokushima (JP); Masamichi Okubata, Tokushima (JP); Fumito Uesugi, Tokushima (JP); Ryuta Kazumori, Tokushima (JP)

(73) Assignees: Otsuka Pharmaceutical Factory, Inc., Tokushima (JP); Otsuka Techno Corporation, Tokushima (JP)

( * ) Notice: Subject to any disclaimer, the term of this patent is extended or adjusted under 35 U.S.C. 154(b) by 773 days.

(21) Appl. No.: 15/536,551

(22) PCT Filed: Dec. 17, 2015

(86) PCT No.: PCT/JP2015/085333
§ 371 (c)(1),
(2) Date: Jun. 15, 2017

(87) PCT Pub. No.: WO2016/098849
PCT Pub. Date: Jun. 23, 2016

(65) Prior Publication Data

US 2017/0360656 A1 Dec. 21, 2017

(30) Foreign Application Priority Data

Dec. 18, 2014 (JP) ..... JP2014-256410

(51) Int. Cl.
*A61J 1/05* (2006.01)
*A61J 1/14* (2006.01)

(52) U.S. Cl.
CPC ..... *A61J 1/05* (2013.01); *A61J 1/1406* (2013.01); *A61J 1/1412* (2013.01); *A61J 1/1475* (2013.01)

(58) Field of Classification Search
CPC combination set(s) only.
See application file for complete search history.

(56) References Cited

U.S. PATENT DOCUMENTS 4,187,149 A * 2/1980 Tolbert ..... A61L 29/041 215/247
4,728,324 A * 3/1988 Steigerwald ..... A61F 5/4405 251/7

(Continued)

FOREIGN PATENT DOCUMENTS

CN 102264433 A 11/2011
CN 103327947 A 9/2013

(Continued)

OTHER PUBLICATIONS

PCT International Preliminary Report dated Jun. 22, 2017 in connection with PCT/JP2015/085333.

(Continued)

*Primary Examiner* — Guy K Townsend
(74) *Attorney, Agent, or Firm* — Brooks Kushman P.C.

(57) ABSTRACT

An object is to provide a port that is capable of securely preventing pulling-out of a sealing plug from a port body. Provided is a port including: a sealing plug through which a hollow needle can be pierced; a port body having a hollow structure with the sealing plug disposed therein; and a pulling-out preventing member to be attached to the port body. The port body includes: a part to be sealed that has a tubular shape with a first end and a second end opposite to the first end, and is configured so that the sealing plug is sealingly inserted into the part to be sealed; a connection part that has a tubular shape, is continuous with the first end of (Continued)

the part to be sealed, and has an outer periphery connected to the bag body to be filled with a medical liquid; and a part to be fitted that is formed in any one of an inner peripheral surface of the part to be sealed, an outer peripheral surface of the part to be sealed, and the second end of the part to be sealed. The pulling-out preventing member includes: a body part that has a first surface directed toward the first end of the part to be sealed within the part to be sealed; a restriction part that is formed on the first surface of the body part and restricts movement of the sealing plug toward the second end of the part to be sealed; and a fitting part that comes into fitting engagement with the part to be fitted of the port body.

10 Claims, 18 Drawing Sheets

(56) References Cited

U.S. PATENT DOCUMENTS 5,403,293 A * 4/1995 Grabenkort ..... A61J 1/1406 604/256
5,676,133 A * 10/1997 Hickle ..... A61M 16/00 128/202.27
6,669,673 B2 * 12/2003 Lopez ..... A61M 5/14 604/249
6,918,500 B2 * 7/2005 Okiyama ..... A61J 1/1406 215/247
7,163,114 B2 1/2007 Okiyama
7,488,311 B2 * 2/2009 Domkowski ..... A61J 1/10 215/247
7,828,787 B2 * 11/2010 Brandenburger ..... A61J 1/1406 604/411
8,118,802 B2 2/2012 Brandenburger et al.
8,641,012 B2 * 2/2014 Matsumoto ..... A61M 39/26 251/149.6
2004/0176703 A1 * 9/2004 Christensen ..... A61B 5/412 600/561
2005/0137574 A1 * 6/2005 Sakai ..... A61B 10/0045 604/514
2005/0234428 A1 * 10/2005 Spohn ..... A61M 39/24 604/533
2005/0251108 A1 * 11/2005 Frassica ..... A61B 1/00154 604/540
2007/0005041 A1 * 1/2007 Frassica ..... A61B 1/0008 604/544
2007/0129679 A1 * 6/2007 Bonnette ..... A61M 5/1422 604/140
2007/0129692 A1 * 6/2007 Enomoto ..... A61M 25/0075 604/284
2007/0255167 A1 * 11/2007 Christensen ..... F16K 17/00 600/561
2008/0039802 A1 * 2/2008 Vangsness ..... A61M 39/26 604/247
2008/0086087 A1 * 4/2008 Spohn ..... A61M 5/1408 604/151
2011/0233435 A1 * 9/2011 Matsumoto ..... A61M 39/26 251/192
2014/0112828 A1 * 4/2014 Grant ..... A61M 1/1686 422/44
2014/0299544 A1 * 10/2014 Wilt ..... F04B 43/14 210/646
2017/0360656 A1 12/2017 Kajihara et al.

FOREIGN PATENT DOCUMENTS

CN 103251507 A 8/2018
EP 1342461 A 9/2003
EP 2394691 A 12/2011
JP S62-179944 U 11/1987
JP H06-225922 A 8/1994
JP H08-252297 A 10/1996
JP 2002-702 A 1/2002
JP 2003-111819 A 4/2003
JP 2014-036001 A 2/2014
JP 5489081 B 3/2014
SG 192151 A 8/2013
WO WO03/099191 A 12/2003
WO WO2010/073643 A 7/2010
WO WO2016/098849 A 6/2016

OTHER PUBLICATIONS

European Search Report dated Jul. 20, 2018 in connection with European Patent Application No. 15870051.8.
Chinese Office Action dated Jun. 28, 2019 in connection with Chinese Patent Appl. No. 201580069200.5.
Indonesian Office Action dated Jan. 14, 2020 issued in connection with related Indonesian Appl. No. PID201704528.
Japanese Office Action issued in connection with related Japanese Appl. No. 2016-564902.
Japanese Office Action dated Apr. 21, 2021 issued in connection with related Japanese Appl. No. 2020-099548.

* cited by examiner

PORT, AND MEDICAL LIQUID BAG

CROSS-REFERENCE TO RELATED APPLICATION

This application claims the benefit of Japanese Patent Application No. 2014-256410, which is incorporated herein by reference.

FIELD OF THE INVENTION

The present invention relates to a port attached to a bag body that stores a medical liquid, and a medical liquid bag provided with the port.

BACKGROUND ART

Hitherto, there has been provided a medical liquid bag that stores a medical liquid (e.g., a liquid containing a medical agent, and a liquid containing a nutritional supplement). As shown in FIG. 17, such a medical liquid bag 4 includes a bag body 40, the inside of which is filled with a medical liquid, and a port 41 attached to the bag body (e.g., Patent Literature 1).

The bag body 40 includes a pair of sheet members 400 that face each other. The pair of sheet members 400 have outer circumferential edges welded together.

As shown in FIG. 18, the port 41 includes a sealing plug 410 through which a hollow needle can be pierced, and a port body 411 having a hollow structure with the sealing plug 410 disposed therein.

The port body 411 includes a part 411*a* to be sealed having a tubular shape into which the sealing plug 410 is sealingly inserted, a connection part 411*b* that is continuous with the part 411*a* to be sealed, has an inside communicating with an inside of the part 411*a* to be sealed, and is disposed between the pair of sheet members 400. The pair of sheet members 400 are welded to an outer periphery of the connection part 411*b*.

The medical liquid bag 4 is placed with the part 411*a* to be sealed of the port 41 directed downward, that is, placed with the part 411*a* to be sealed positioned downward of the bag body 40, while a hollow needle is being pierced into the sealing plug 410. In this state, a medical liquid within the bag body 40 is ready to be able to be administered to a patient via the hollow needle.

According to the medical liquid bag 4 having the above configuration, for example, when the part 411*a* to be sealed is directed downward, a liquid pressure due to the weight of the medical liquid is applied to the sealing plug 410. That is, the weight of the medical liquid within the bag body 40 acts as a force causing the sealing plug 410 to be pulled out of the port body 411.

Therefore, in the medical liquid bag 4 of this type, there is a demand for preventing such pulling-out of the sealing plug 410 from the port body 411. In order to suffice such a demand, the port 41 includes a pulling-out prevention part 411*c* that is formed continuously with the part 411*a* to be sealed and is configured to abut against the sealing plug 410.

The pulling-out prevention part 411*c* has a proximal end connected to the part 411*a* to be sealed and a distal end opposite to the proximal end. The pulling-out prevention part 411*c* is bent to cause the distal end thereof to be directed toward the sealing plug 410, and the distal end is brought into abutting contact with the sealing plug 410 over the entire circumference. Whereby, the sealing plug 410 can be prevented from being pulled out of the port body 411.

In the thus configured port 41, the pulling-out prevention part 411*c* is formed by pre-heating an extension 411*d* (hereinafter referred to as the "bending margin") extending straight from the part 411*a* to be sealed, and then being subjected to bending.

Therefore, in manufacturing the port 41, a facility exclusively used for forming the pulling-out prevention part 411*c* is needed. Also, since the port 41 is manufactured through a process with heat applied, a manufacturing efficiency is not high. Further, in a method for manufacturing the port 41, the shape of the port 41 may be varied depending on the position in the circumferential direction of the pulling-out prevention part 411*c*. Therefore, the port 41 manufactured by the aforesaid method may not be able to evenly press the sealing plug 410 along the entire periphery of the distal end of the pulling-out prevention part 411*c*.

Therefore, in the thus configured port 41, the sealing plug 410 may be pulled out of the port body 411 due to external force acting on the sealing plug 410.

PRIOR ART LITERATURE

Patent Literature

[Patent Literature 1] JP 2014-36001 A

SUMMARY OF THE INVENTION

Problem to be Solved by the Invention

The present invention therefore provides a port that is capable of securely preventing pulling-out of a sealing plug from a port body, and a medical liquid bag provided with the port.

Means to Solve the Problem

According to the present invention, there is provided a port including: a sealing plug through which a hollow needle can be pierced; a port body having a hollow structure with the sealing plug disposed therein; and a pulling-out preventing member to be attached to the port body. The port body includes: a part to be sealed that has a tubular shape with a first end and a second end opposite to the first end in a center axis direction thereof, and is configured so that the sealing plug is sealingly inserted into the part to be sealed; a connection part that has a tubular shape, is continuous with the first end of the part to be sealed, and has an outer periphery connected to the bag body to be filled with a medical liquid; and a part to be fitted that is formed in any one of an inner peripheral surface of the part to be sealed, an outer peripheral surface of the part to be sealed, and the second end of the part to be sealed. The pulling-out preventing member includes: a body part that has a first surface directed toward the first end of the part to be sealed within the part to be sealed; a restriction part that is formed on the first surface of the body part and restricts movement of the sealing plug toward the second end of the part to be sealed; and a fitting part that comes into fitting engagement with the part to be fitted of the port body, wherein the part to be fitted and the fitting part engage with each other so as to be able to transmit a force which is directed in the center axis direction of the part to be sealed, in the state where the part to be fitted and the fitting part are held in fitting engagement with each other.

According to the present invention, there is provided a port including: a sealing plug through which a hollow needle can be pierced; a port body having a hollow structure with the sealing plug disposed therein; and a pulling-out preventing member to be attached to the port body. The port body includes: a part to be sealed that has a tubular shape with a first end and a second end opposite to the first end in a center axis direction thereof, and is configured so that the sealing plug is sealingly inserted into the part to be sealed; a connection part that has a tubular shape, is continuous with the first end of the part to be sealed, and has an outer periphery connected to the bag body to be filled with a medical liquid; and a part to be fitted that is formed in any one of an inner peripheral surface of the part to be sealed, an outer peripheral surface of the part to be sealed, and the second end of the part to be sealed. The pulling-out preventing member includes: a body part that has a first surface directed toward the first end of the part to be sealed within the part to be sealed; a restriction part that is formed on the first surface of the body part and restricts movement of the sealing plug toward the second end of the part to be sealed; and a fitting part that comes into fitting engagement with the part to be fitted of the port body. The part to be fitted has an engaging surface that is directed toward the one end side of the part to be sealed, and the fitting part has an engaging surface that is directed toward the second end side of the part to be sealed and faces the engaging surface of the part to be fitted.

It may be configured so that the part to be fitted is any one of a recess part and a projection part, and the fitting part is a remaining one of the recess part and the projection part.

Further, it may be configured so that the fitting part of the pulling-out preventing member comes into contact with a portion of the part to be fitted of the port body over the entire periphery in the circumferential direction of the fitting part or through plural places of the periphery in the circumferential direction of the fitting part.

Further, it may be configured so that the sealing plug has a groove formed on a surface opposite to the pulling-out preventing member, and the restriction part of the pulling-out preventing member projects into the groove from the first surface of the body part.

According to another aspect of the present invention, there is provided a medical liquid bag including: a bag body, the inside of which is filled with a medical liquid; and any one of the aforesaid port, wherein the port includes a connection part that is connected to the bag body.

DETAILED DESCRIPTION OF THE PREFERRED EMBODIMENT

The description is given for one embodiment of the present invention with reference to the drawings attached hereto.

Figure 1:
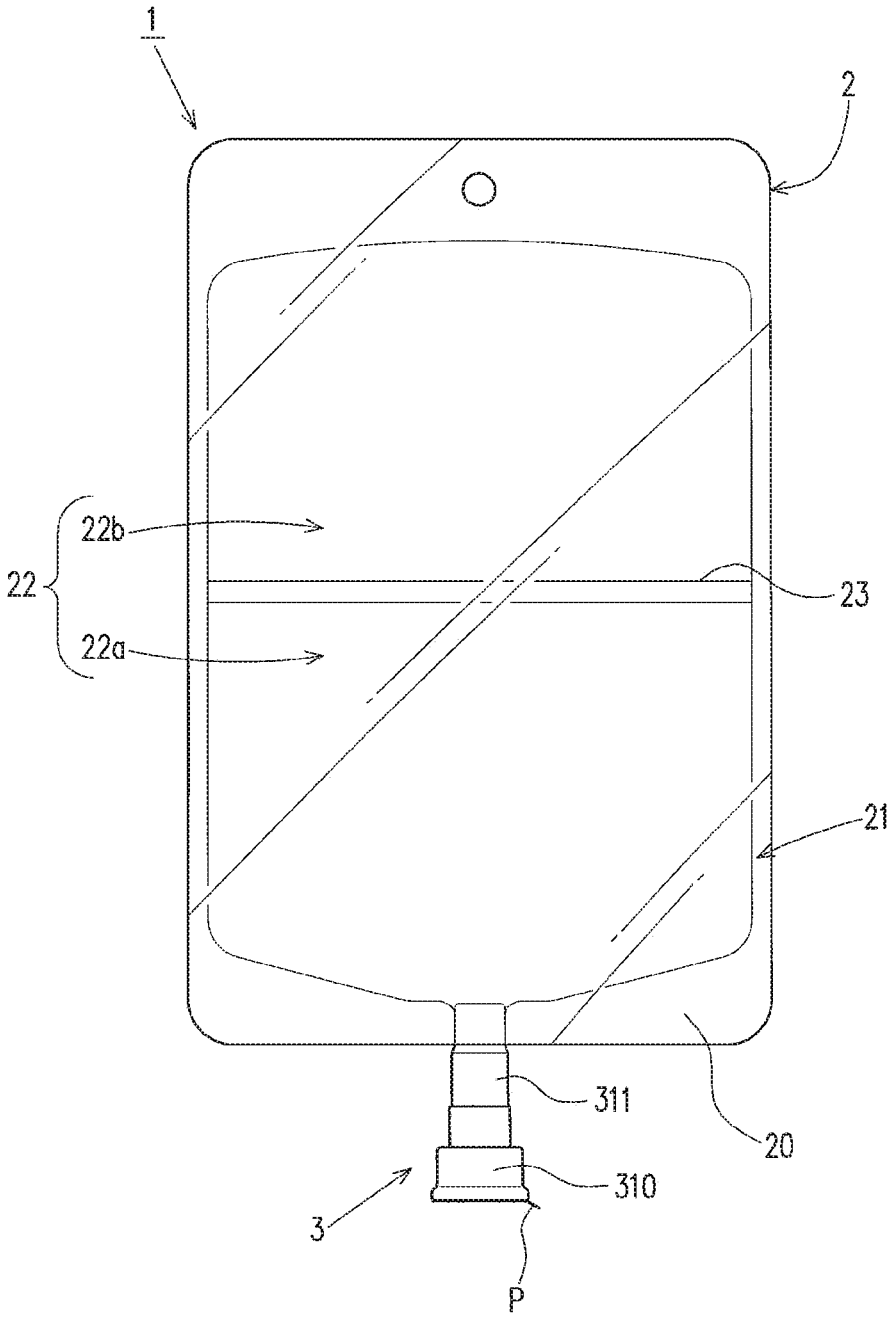
FIG. 1 is a front view of a medical liquid bag according to one embodiment of the present invention.

As shown in FIG. 1, a medical liquid bag 1 includes a bag body 2 that is configured to be filled with a medical liquid (e.g., a liquid containing a medical agent for infusion, and a liquid containing a nutritional supplement), and a port 3 attached to the bag body 2.

The bag body 2 includes a pair of opposite sheet members 30 overlapping each other. The bag body 2 includes a seal part 21 formed by welding the outer circumferential edges of the opposite sheet members 20. The bag body 2 includes a storage chamber 22 defined by the pair of sheet members 20 and the seal part 21.

In the present embodiment, the bag body 2 includes a weak seal part 23 formed by separably bonding the pair of sheet members 20.

The weak seal part 23 is formed to partition the storage chamber 22 into plural spaces. In this embodiment, the weak seal part 23 partitions the storage chamber 22 into two spaces. That is, the storage chamber 22 includes two spaces 22*a* and 22*b* that can communicate with each other. In this embodiment, a description is given with one space 22*a* of the storage chamber 22 being served as a first storage chamber 22*a* and another space 22*b* of the storage chamber 22 being served as a second storage chamber 22*b*.

The first storage chamber 22*a* and the second storage chamber 22*b* respectively store therein different kinds of medical liquid. In the bag body 2, when the weak seal part 23 is ruptured, the first storage chamber 22*a* and the second storage chamber 22*b* come into communication with each other. Whereby, a medical liquid within the first storage chamber 22*a* is mixed with a medical liquid within the second storage chamber 22*b*.

Figure 2:
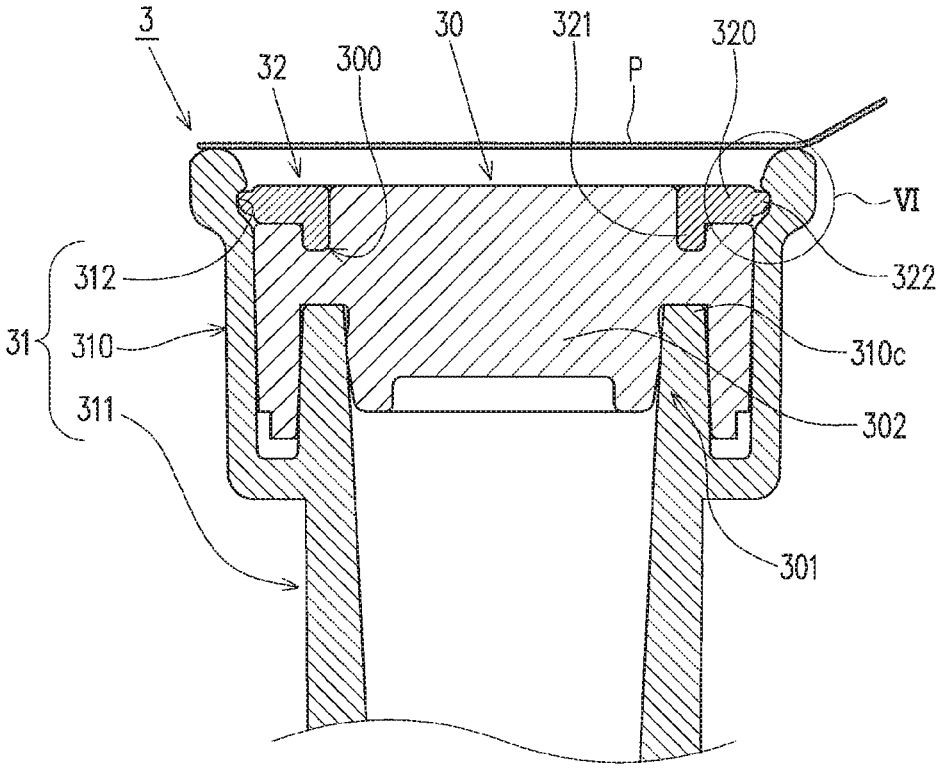
FIG. 2 is a longitudinal cross section of a port according to the one embodiment.

As shown in FIG. 2, the port 3 includes a sealing plug 30 through which a hollow needle can be pierced, a port body 31 having a hollow structure with the sealing plug 30 disposed therein, and a pulling-out preventing member 32 to be attached to the port body 31.

The sealing plug 30 has a first surface located on a pulling-out preventing member 32 side and a second surface located opposite to the first surface.

Figure 3:
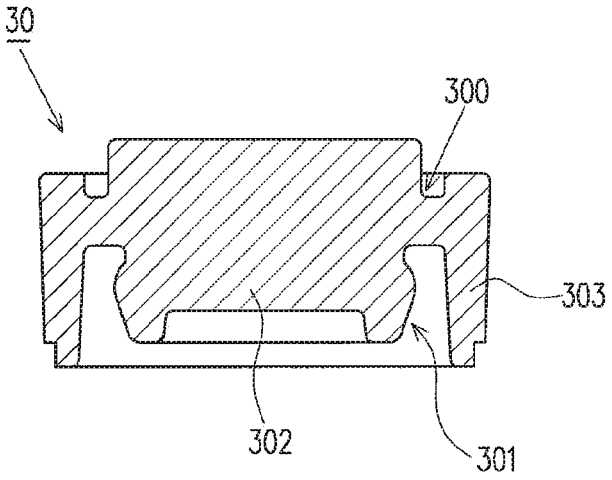
FIG. 3 is a longitudinal cross section of a sealing plug according to the one embodiment.

As shown in FIG. 3, the sealing plug 30 has an annular groove 300 formed on a surface opposite to the pulling-out preventing member 32 (formed on the first surface in this embodiment).

A center portion of the first surface of the sealing plug 30 (a portion inward of the groove 300 of the first surface) has a height higher than an outer peripheral edge of the first surface of the sealing plug 30 (higher than a portion outward of the groove 300 of the first surface). That is, the center portion of the first surface of the sealing plug 30 is located closer to the pulling-out preventing member 32 in the center axis direction than the outer peripheral edge of the first surface of the sealing plug 30 is.

With the above configuration, the center portion of the first surface of the sealing plug 30 can be easily subjected to various workings (e.g., disinfecting with alcohol).

The sealing plug 30 has an annular recess part 301 opened toward the side opposite to the pulling-out preventing member 32 side. The annular recess part 301 is formed in the second surface.

The sealing plug 30 has an extension 302 that extends toward a side opposite to the pulling-out preventing member 32 side from the center portion of the second surface, and an annular projection part 303 that surrounds an outer peripheral surface of the extension 302.

The outer peripheral surface of the extension 302 bulges toward the annular projection part 303 over the entire periphery in the circumferential direction.

Figure 4:
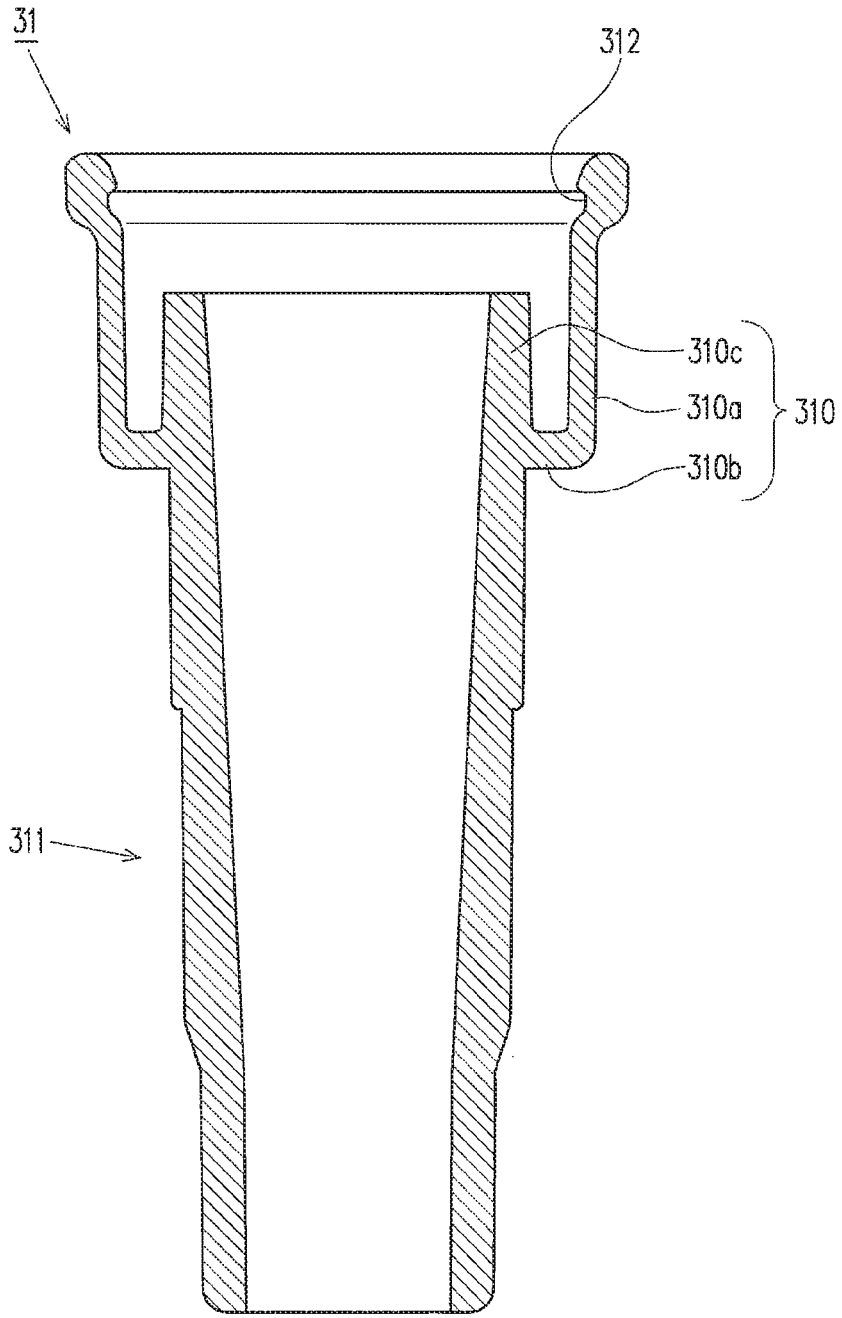
FIG. 4 is a longitudinal cross section of a port body according to the one embodiment.

As shown in FIG. 4, the port body 31 includes a part 310 to be sealed that has a tubular shape with a first end and a second end opposite to the first end in the center axis direction, and is configured so that the sealing plug 30 is sealingly inserted into the part 310 to be sealed, a connection part 311 that has a tubular shape, is continuous with the first end of the part 310 to be sealed, and has an outer periphery welded to the bag body 2, and a part 312 to be fitted that is formed in any one of an inner peripheral surface of the part 310 to be sealed, an outer peripheral surface of the part 310 to be sealed, and the second end of the part 310 to be sealed.

The part 310 to be sealed of the present embodiment includes an outer wall part 310*a* having a tubular shape, and a continuous part 310*b* for connection between the outer wall part 310*a* and the connection part 311.

The outer wall part 310*a* has a first end and a second end opposite to the first end in the center axis direction. The first end of the outer wall part 310*a* is continuous with the connection part 311 via the continuous part 310*b*.

The outer wall part 310*a* has an inner peripheral surface to come into contact with the outer peripheral surface of the sealing plug 30 over the entire periphery in the circumferential direction. A recess part (groove) as the part 312 to be fitted extends continuously in the circumferential direction in the inner peripheral surface on the second end side of the outer wall part 310*a*. A peelable seal P is applied to the second end of the part 310 to be sealed (outer wall part 310*a*) according to the present embodiment (see FIG. 2).

The thickness of the second end of the outer wall part 310*a* is set to be greater than the thickness of the first end of the outer wall part 310*a*. With this, the second end of the outer wall part 310*a* has a rigidity higher than the rigidity of the first end side of the outer wall part 310*a*.

The continuous part 310*b* extends from the first end of the outer wall part 310*a* over the entire periphery in the circumferential direction toward an inner side in a radial direction. The continuous part 310*b* has an inner peripheral edge being continuous with the connection part 311.

The part 310 to be sealed further includes an annular support part 310*c* that extends from the continuous part 310*b* toward the second end of the outer wall part 310*a*. In the part 310 to be sealed, the outer peripheral surface of the support part 310*c* and the inner peripheral surface of the outer wall part 310*a* face each other with a distance from each other. That is, in the part 310 to be sealed, a clearance is formed between the outer peripheral surface of the support part 310*c* and the inner peripheral surface of the outer wall part 310*a*.

As shown in FIG. 2, in the port 3 according to the present embodiment, the extension 302 of the sealing plug 30 is sealingly inserted into or is disposed in the inside of the support part 310*c*. Along with this, the support part 310*c* is sealingly inserted into or is disposed in the annular recess part 301 of the sealing plug 30.

As described above, the outer peripheral surface of the extension 302 bulges toward the annular projection part 303 over the entire periphery in the circumferential direction. With this, the extension 302 of the sealing plug 30 more tightly contacts the support part 310*c*.

As shown in FIG. 4, the connection part 311 extends from the first end of the part 310 to be sealed. Specifically, the connection part 311 has a first opening end and a second opening end opposite to the first opening end in the center axis direction. In the present embodiment, the first opening end of the connection part 311 is continuous with the part 310 to be sealed. The pair of sheet members 20 each are welded to the outer peripheral surface on the second end side of the connection part 311 (see FIG. 1).

The part 312 to be fitted is a recess part formed in the inner peripheral surface of the part 310 to be sealed. The part 312 (recess part) to be fitted according to the present embodiment continuously extends in the inner peripheral surface of the part 310 to be sealed over the entire periphery in the circumferential direction. That is, the part 312 to be fitted (recess part) 312 has an endless annular shape. In the present embodiment, the part 312 (recess part) to be fitted is formed in the inner peripheral surface on the second end side of the outer wall part 310*a*.

Figure 5:
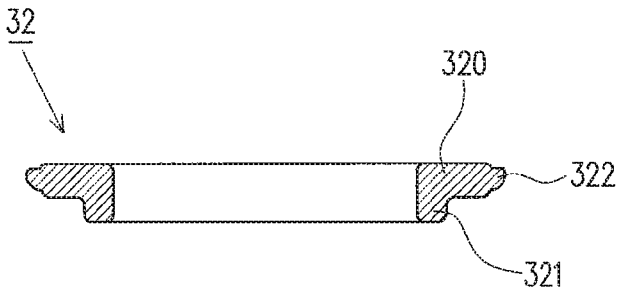
FIG. 5 is a longitudinal cross section of a pulling-out prevention member according to the one embodiment.

As shown in FIG. 5, the pulling-out preventing member 32 has an annular shape. As shown in FIG. 2, the pulling-out preventing member 32 is laid on the first surface of the sealing plug 30, which first surface faces outward within the part 310 to be sealed. The pulling-out preventing member 32 includes an annular body part 320 that has a first surface directed toward the first end of the part 310 to be sealed (toward the sealing plug 30 in the present embodiment), an annular restriction part 321 that is formed on the first surface of the body part 320 and restricts movement of the sealing plug 30 toward the second end of the part 310 to be sealed, and a fitting part 322 that comes into fitting engagement with the part 312 to be fitted of the port body 31.

The first surface of the body part 320 includes a facing area that faces an outwardly facing surface of the sealing plug 30 disposed within the part 310 to be sealed (the first surface of the sealing plug 30). The pulling-out preventing member 32 has an annular shape and accordingly the facing area is an annular shaped area having an outer periphery defined by the outer periphery of the body part 320. The body part 320 has a second surface opposite to the first surface. The second surface of the annular body part 320 constitutes an outer surface that faces outward within the part 310 to be sealed, and is located on the same plane or substantially the same plane as that of the first surface of the sealing plug 30 (a center portion of the first surface of the sealing plug 30 in the present embodiment). A more specific description is given. The second surface (outer surface) of the body part 320 has a flat surface shape. The second surface (outer surface) of the body part 320 is located at a position matching to or substantially matching to the first surface of the sealing plug 30 (matching to the center portion of the first surface of the sealing plug 30 in the present embodiment) in the center axis direction of the port body 31.

The restriction part 321 projects from the first surface of the annular body part 320. In the present embodiment, the restriction part 321 projects toward the sealing plug 30 from the first surface of the body part 320. The restriction part 321 projects toward the sealing plug 30 from an area of the first surface excluding the facing area that faces the sealing plug 30. In the present embodiment, the restriction part 321 projects toward the sealing plug 30 from an annular area located on the inner peripheral side of the facing area of the first surface of the body part 320. The restriction part 321 is disposed within the groove 300 of the sealing plug 30. In the pulling-out preventing member 32 according to the present embodiment, the restriction part 321 abuts against the sealing plug 30.

As described above, in the pulling-out preventing member 32 according to the present embodiment, the restriction part 321 projecting from the first surface of the body part 320 is disposed within the groove 300 of the sealing plug 30. Along with this, the pulling-out preventing member 32 comes into abutting engagement with the sealing plug 30 through not only the restriction part 321 but also the facing area of the first surface of the body part 320.

The restriction part 321 is formed on the inner peripheral edge side of the body part 320. Therefore, in the pulling-out preventing member 32, the thickness on the inner peripheral edge side of the annular body part 320 is greater than the thickness on the outer peripheral edge side of the body part 320. Whereby, the inner peripheral edge side of the pulling-out preventing member 32 has a higher rigidity.

As described above, the part 312 to be fitted of the port body 31 is a recess part that is formed in the inner peripheral surface of the part 310 to be sealed and continuously extends in the inner peripheral surface of the part 310 to be sealed over the entire periphery in the circumferential direction. Along with this, the fitting part 322 extends radially outwardly from the outer peripheral surface of the body part 320 and continuously extends in the outer peripheral surface of the body part 320 over the entire periphery in the circumferential direction.

The entire periphery in the circumferential direction of the fitting part 322 abuts against the part 312 to be fitted of the port body 31.

Figure 6:
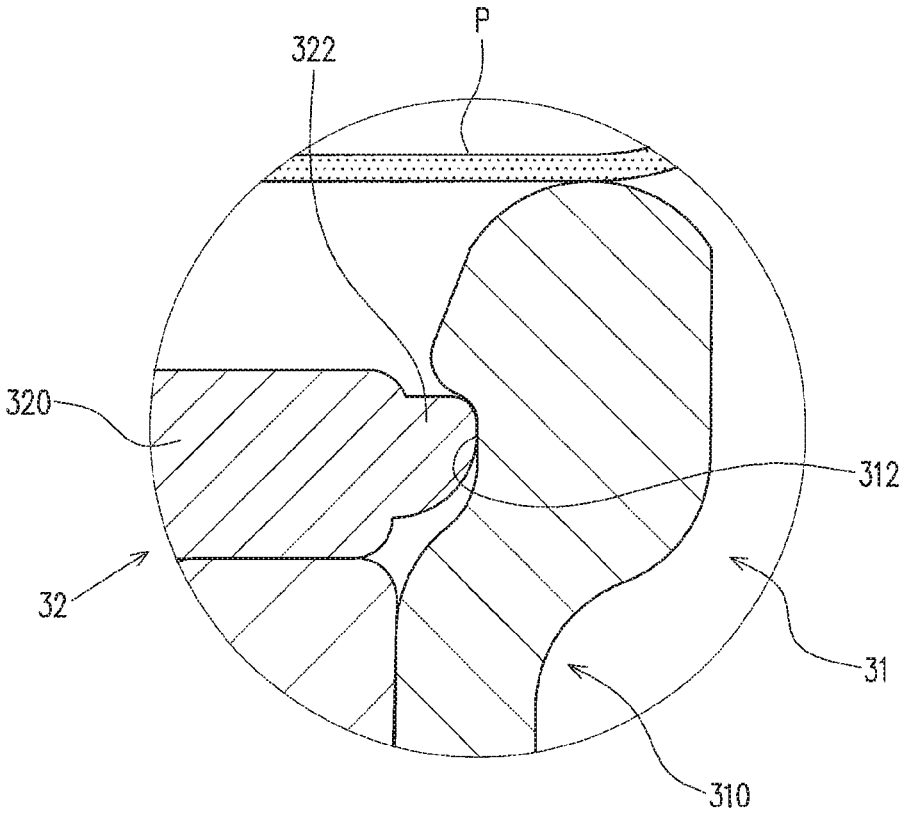
FIG. 6 is an enlarged view of the port according to the one embodiment, and is an enlarged view of an area VI of FIG. 2.

In the present embodiment, the entire periphery in the circumferential direction of the fitting part 322 of the pulling-out preventing member 32 comes into line contact with or into partial surface contact with the part 312 to be fitted of the port body 31. A more specific description is given. As shown in FIG. 6, the part 312 to be fitted of the port body 31 and the fitting part 322 (outer peripheral surface) each have an arc shape. The curvature of the part 312 to be fitted is smaller than the curvature of the outer peripheral surface of the fitting part 322 of the pulling-out preventing member 32. With this configuration, the entire periphery in the circumferential direction of the fitting part 322 comes into line contact with or into partial surface contact with the part 312 to be fitted of the port body 31.

With the above configuration, it is possible to effectively prevent the pulling-out preventing member 32 from falling out, and enable the fitting part 322 of the pulling-out preventing member 32 to be easily fitted into the part 312 to be fitted.

The medical liquid bag 1 according to the present embodiment is as described above. Now, the description is given for a method of using the medical liquid bag 1 with reference to the drawings attached hereto.

When the medical liquid bag 1 is used (for example, when a medical liquid within the bag body 2 is administered to a patient), the first storage chamber 22*a* or the second storage chamber 22*b* of the bag body 2 is pressed. Whereby, the weak seal part 23 is ruptured so that the first storage chamber 22*a* communicates with the second storage chamber 22*b*. As a result, a medical liquid within the first storage chamber 22*a* and a medical liquid within the second storage chamber 22*b* are mixed together.

Figure 7:
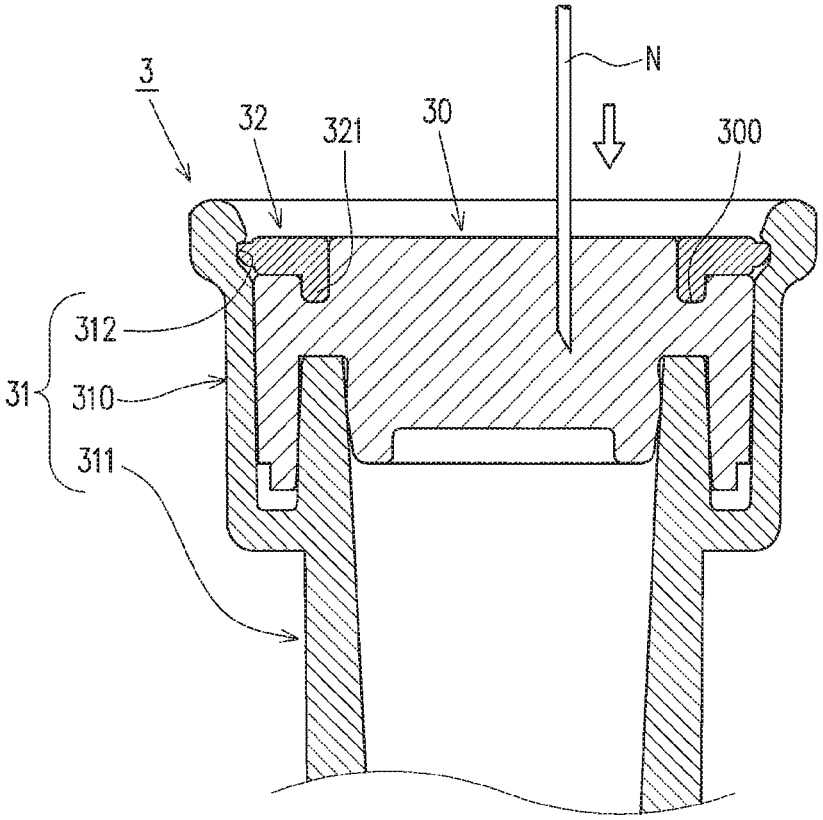
FIG. 7 is a longitudinal cross section according to the one embodiment, showing a state where a hollow needle is pierced into the sealing plug.

Then, the peelable seal P is removed from the second end of the part 310 to be sealed, and, as shown in FIG. 7, the medical liquid bag 1 is suspended from a drip infusion stand or the like (not shown) with the port body 31 (the part 310 to be sealed) directed downward. Then, a hollow needle N is pierced into the sealing plug 30. Whereby, a medical liquid is taken out from the bag body 2 via the hollow needle N.

As described above, according to the port 3 of the medical liquid bag 1 of the present embodiment, the pulling-out preventing member 32 is fixed to the port body 31 through a fitting engagement between the part 312 to be fitted of the port body 31 and the fitting part 322 of the pulling-out preventing member 32.

In the above state, the restriction part 321 of the pulling-out preventing member 32 abuts against the sealing plug 30 over the entire periphery in the circumferential direction, so that the pulling-out preventing member 32 evenly presses the sealing plug 30 over the entire periphery in the circumferential direction of the restriction part 321. Accordingly, it is possible to more securely prevent the sealing plug 30 from being pulled out of the port body 31.

In the present embodiment, since the fitting part 322 of the pulling-out preventing member 32 is fitted into the part 312 to be fitted of the port body 31, the port can be more efficiently assembled than a conventional port which requires preheating or bending work.

Since the entire periphery in the circumferential direction of the fitting part 322 of the pulling-out preventing member 32 comes into line contact or partial surface contact with the part 312 to be fitted of the port body 31, a clearance is formed on the upper side or lower side of the contacting portion between the fitting part 322 of the pulling-out preventing member 32 and the part 312 to be fitted of the port body 31.

Whereby, the pulling-out preventing member 32 may change its contacting position with respect to the part 312 to be fitted of the fitting part 322, and therefore is fixed to the port body 31 while being adjusted in position according to tilting or positional displacement of the sealing plug 30. As a result, the pulling-out preventing member 32 more appropriately presses the sealing plug 30.

In the conventional port, the pulling-out preventing member is formed by subjecting the port body to bending work after the sealing port is sealingly inserted into the port body. Therefore, in the conventional port, when the sealing plug is sealingly inserted into the port body while it is being tilted, the shape of the port body may not remain constant and hence the sealing plug may fall out of the port body.

However, in the port 3 according to the present embodiment, the port body 31 and the pulling-out preventing member 32 are formed independently of each other, the pulling-out preventing member 32 can be attached to the port body 31 at the same time when the sealing plug 30 is sealingly inserted into the port body 31. Accordingly, in the port 3 according to the present embodiment, it is possible to appropriately suppress occurrence of changing in shape of the port body 31 depending on its position in the circumferential direction, and more effectively prevent falling-out of the sealing plug 30.

Further, the second end of the outer wall part 310*a* of the part 310 to be sealed has a rigidity higher than that of the first end side of the outer wall part 310*a* of the part 310 to be sealed. That is, in the port 3, the rigidity of the portion through which the pulling-out preventing member 32 is fitted to the port body 31 is increased. Whereby, it is possible to more securely prevent the pulling-out preventing member 32 from falling out of the port body 31.

In the port 3, the restriction part 321 of the pulling-out preventing member 32 is disposed within the groove 300 of the sealing plug 30. Therefore, when the sealing plug 30 is subjected to an external force acting in a direction in which the sealing plug 30 is pulled out of the opening on the second end side of the part 310 to be sealed, the sealing plug 30 is pressed onto the pulling-out preventing member 32. Accordingly, the sealing plug 30 is subjected to a reaction force from the pulling-out preventing member 32. That is, a portion of the sealing plug 30 which defines the groove 300 is supported by the restriction part 321 of the pulling-out preventing member 32. Thus, according to the medical liquid bag (the port 3) of the present embodiment, the sealing plug 30 is prevented from falling out of the port body 31.

A more specific description is given. In the medical liquid bag 1 according to the present embodiment, as described above, the first storage chamber 22*a* of the bag body 2 is pressed to rupture the weak seal part 23. In this case, the sealing plug 30 is subjected to a liquid pressure of a medical liquid within the storage chamber 22 (the first storage chamber 22*a*).

However, according to the port 3, the sealing plug 30 is pressed by the pulling-out preventing member 32 fixed to the port body 31, the sealing plug 30 can be prevented from falling out of the port body 31.

Further, in the medical liquid bag 1 according to the present embodiment, even when the part 310 to be sealed is directed downward, the sealing plug 30 is subjected to a liquid pressure of a medical liquid within the storage chamber 22. However, the sealing plug 30 is pressed by the pulling-out preventing member 32 fixed to the port body 31 in the port 3, the sealing plug 30 is prevented from falling out of the port body 31.

Further, in the medical liquid bag 1 according to the present embodiment, as described above, the hollow needle N is pierced into the sealing plug 30. At this time, the sealing plug 30 is subjected to an external force acting toward the inside of the bag body 2.

Subsequently, the annular projection part 303 of the sealing plug 30 is drawn into a center portion side of the port body 31 and thereby the support part 310*c* of the part 310 to be sealed is pressed by the annular projection part 303. Then, the annular projection part 303 of the sealing plug 30 is subjected to a reaction force from the support part 310*c* of the part 310 to be sealed.

Therefore, since the annular projection part 303 of the sealing plug 30 is supported by the support part 310*c* of the part 310 to be sealed, the sealing plug 30 located within the port body 31 is prevented from falling out into or being forced into the bag body 2 of the sealing plug 30.

Figure 8:
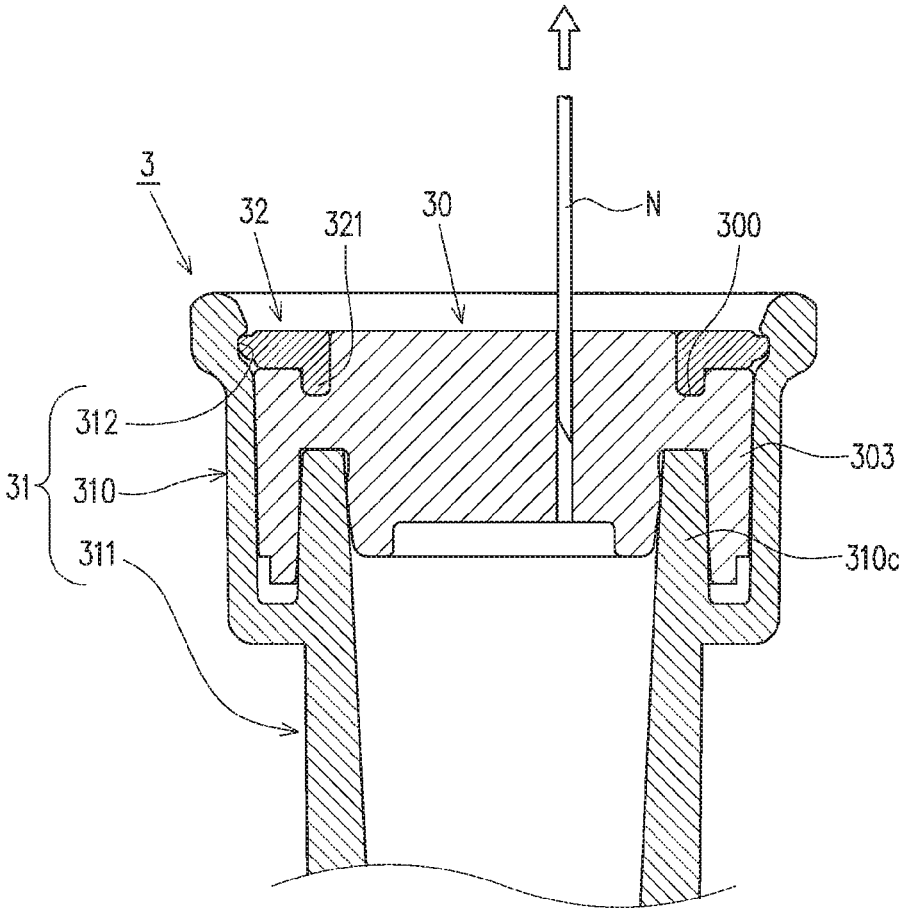
FIG. 8 is a longitudinal cross section of the port according to the one embodiment, showing a state where the hollow needle pierced into the sealing plug is being pulled out.

In the medical liquid bag 1 according to the present embodiment, as shown in FIG. 8, the hollow needle N pierced into the sealing plug 30 is sometimes pulled out. In such a case, the sealing plug 30 is subjected to an external force acting in a direction away from the bag body 2.

Whereby, the outer peripheral edge portion of the sealing plug 30 (outer peripheral edge portion on the first surface side) is drawn into the center portion side of the port body 31, and thereby the restriction part 321 of the pulling-out preventing member 32 is pressed by the outer peripheral edge portion of the sealing plug 30. Then, the outer peripheral edge portion of the sealing plug 30 is subjected to a reaction force from the restriction part 321 of the pulling-out preventing member 32.

Accordingly, the outer peripheral edge portion of the sealing plug 30 is supported by the restriction part 321 of the pulling-out preventing member 32, and thereby the sealing plug 30 is prevented from falling out of the port body 31.

As described above, the second end of the outer wall part 310*a* has a rigidity higher than that of the first end side of the outer wall part 310*a*, and therefore the peelable seal P can be appropriately and easily applied to the port body 31 (the second end of the part 310 to be sealed).

The present invention is not necessarily limited to the above embodiment, and may be subjected to various modifications within the scope intended by the present invention.

In the above embodiment, the port body 31 has only one single part 310 to be sealed, but this is not essential. For example, the port body 31 may have two or more parts 310 to be sealed. In this case, the sealing plug 30 is sealingly inserted into each of the parts 310 to be sealed, and the pulling-out preventing member 32 is attached to each of the parts 310 to be sealed.

In the above embodiment, the bag body 2 is formed by welding together the outer peripheral edge portions of the pair of sheet members 20 overlapping each other, but this is not essential. For example, the bag body 2 may be formed by closing (for example, welding) the opening portions on the opposite ends of a sheet (or a film) formed into a tubular shape.

In the above embodiment, the bag body 2 and the port 3 are connected by welding, but this is not essential. For example, the bag body 2 and the port 3 may be connected by adhesive or the like.

In the above embodiment, the two spaces (the first storage chamber 22*a* and the second storage chamber 22*b*) are formed within the bag body 2, but this is not essential. For example, only one single space or three or more spaces may be formed within the bag body 2.

In the above embodiment, the one single port 3 is attached to the medical liquid bag 1, but this is not essential. For example, two or more ports 3 may be attached to the medical liquid bag 1.

In the above embodiment, the center portion of the first surface of the sealing plug 30 is located on the same plane or substantially the same plane as that of the second surface of the body part 320, but this is not essential. For example, the center portion of the first surface of the sealing plug 30 may project away from the second surface of the body part 320. Even with this configuration, the center portion of the first surface of the sealing plug 30 can be easily subjected to various workings (e.g., disinfecting with alcohol).

In the above embodiment, the groove 300 of the sealing plug 30 has an annular shape, but this is not essential. The groove 300 may have such a shape as to conform with the shape or configuration of the restriction part 321 projecting from the first surface of the body part 320.

In the port body 31 of the above embodiment, the connection part 311 and the part 310 to be sealed are formed integrally with each other, but this is not essential. For example, in the port body 31, the connection part 311 and the part 310 to be sealed may be formed separately from each other.

Figure 9:
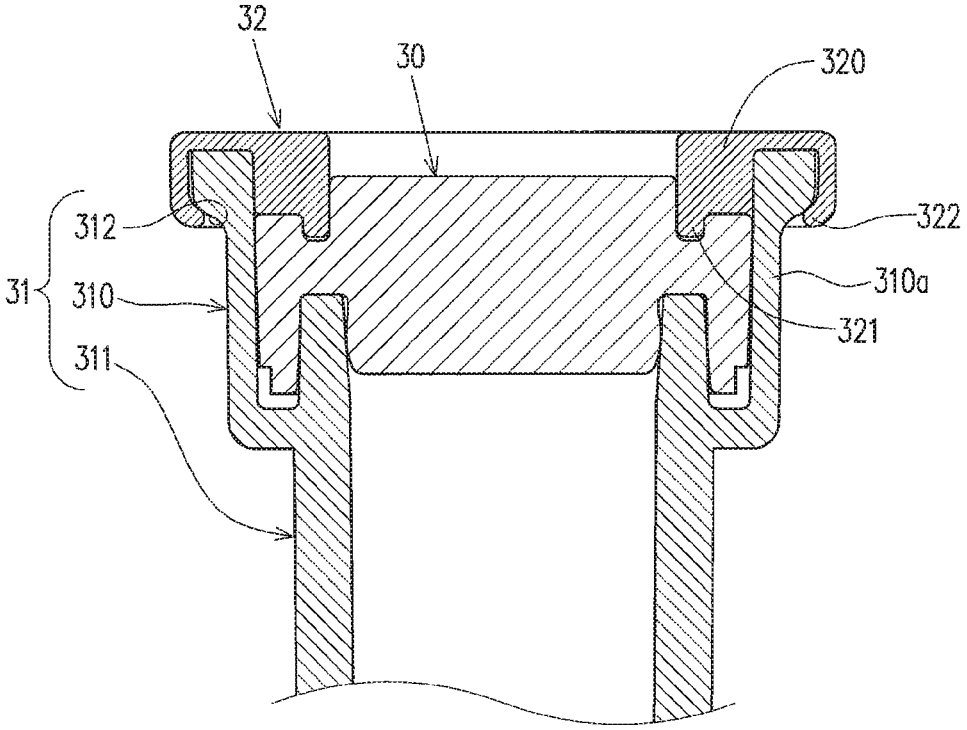
FIG. 9 is a longitudinal cross section of a part of a port according to another embodiment of the present invention.

In the above embodiment, the part 312 to be fitted is formed in the inner peripheral surface on the second end side of the part 310 to be sealed, but this is not essential. For example, the part 312 to be fitted may be formed in the outer peripheral surface of the part 310 to be sealed, as shown in FIG. 9.

In the above case, the pulling-out preventing member 32 may be formed so as to cover the second end side of the part 310 to be sealed, and the fitting part 322 may be formed at a position corresponding to the part 312 to be fitted formed in the outer peripheral surface of the part 310 to be sealed, or may be formed at a position at which the fitting part 322 can be fitted into the part 312 to be fitted.

Figure 10:
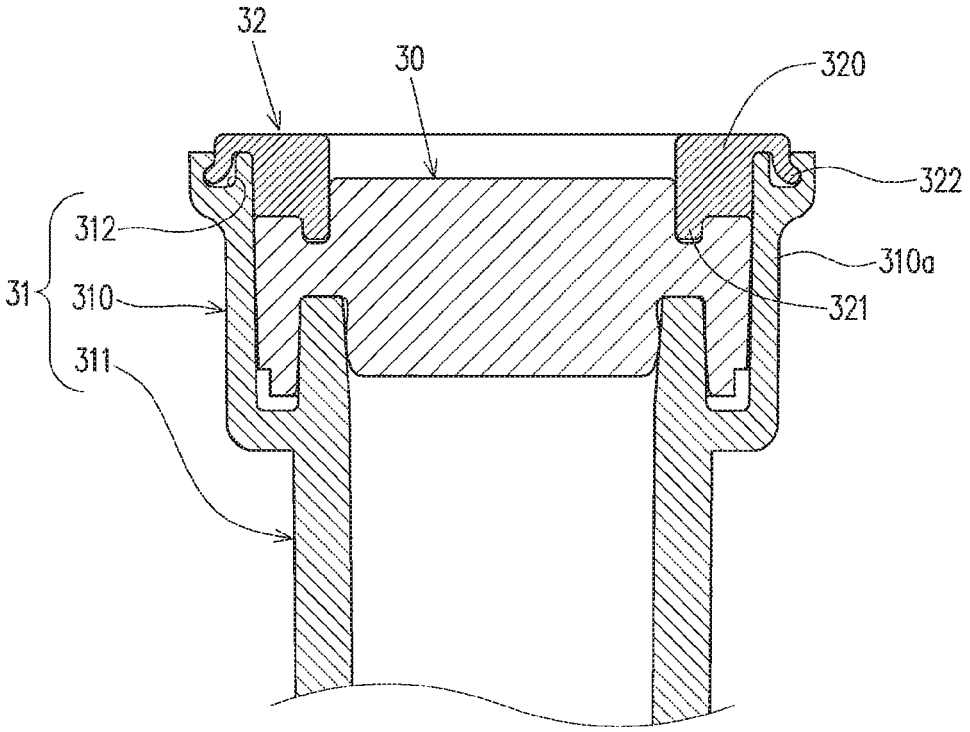
FIG. 10 is a longitudinal cross section of a port according to still another embodiment of the present invention.

As shown in FIG. 10, the part 312 to be fitted may be formed in the second end of the part 310 to be sealed. In this case, it may be configured so that the body part 320 is formed so as to rest on or partially cover the second end of the part 310 to be sealed, and the fitting part 322 is formed at a position corresponding to the part 312 to be fitted formed in the second end, or is formed at a position at which the fitting part 322 can be fitted into the part 312 to be fitted formed in the second end.

In the above embodiment, the part 312 to be fitted is constituted by the recess part (groove) that extends continuously over the entire periphery in the circumferential direction of the inner peripheral surface of the part 310 to be sealed (the outer wall part 310*a*), but this is not essential. For example, the part 312 to be fitted may be formed by plural recess parts formed intermittently in the inner peripheral surface in the circumferential direction. In this case, the fitting part 322 of the pulling-out preventing member 32 may be constituted by plural projection parts formed at positions corresponding respectively to the recess parts of the part 312 to be fitted.

In the above embodiment, the restriction part 321 of the pulling-out preventing member 32 projects toward the sealing plug 30 from the first surface of the body part 320, but this is not essential. The restriction part 321 of the pulling-out preventing member 32 may be formed on the first surface of the body part 320, and, for example, may be constituted by at least a portion of the first surface of the body part 320, provided that the restriction part 321 can abut against the sealing plug 30. In this case, the restriction part 321 is constituted by an area adjacent to the facing area of the first surface, which face area faces the sealing plug 30, or by the facing area itself. The restriction part 321 is not necessarily limited to the configuration in which it extends continuously in the circumferential direction or is formed into an annular shape. For example, plural restriction parts 321 may be provided and are disposed at plural places on the first surface of the body part 320.

In the above embodiment, the restriction part 321 of the pulling-out preventing member 32 abuts against the sealing plug 30, but this is not essential. The restriction part 321 may be disposed to have a clearance between itself and the sealing plug 30. In this case, when the sealing plug 30 is moved toward the second end of the part 310 to be sealed within the part 310 to be sealed, it is matter of course that the restriction part 321 interferes with (abuts against) the sealing plug 30, and the pulling-out preventing member 32 (the restriction part 321) holds the sealing plug 30 within the part 310 to be sealed.

Although not specifically referred in the above embodiment, the pulling-out preventing member 32 and the sealing plug 30 may be separated from each other, or may be connected to each other by, for example, adhesive to be integral with each other. When the pulling-out preventing member 32 and the sealing plug 30 are separated from each other, the pulling-out preventing member 32 is attached to the part 310 to be sealed after the sealing plug 30 is sealingly inserted into the part 310 to be sealed. On the other hand, when the pulling-out preventing member 32 and the sealing plug 30 are connected by, for example, adhesive, the pulling-out preventing member 32 is attached to the part 310 to be sealed at a timing when the sealing plug 30 is sealingly inserted into the part 310 to be sealed.

In the above embodiment, while the body part 320 of the pulling-out preventing member 32 is laid on the first surface of the sealing plug 30, the restriction part 321 is also laid on the first surface side of the sealing plug 30, but this is not essential. It may be configured so that the restriction part 321 is embedded between the first surface and the second surface of the sealing plug 30, and the pulling-out preventing member 32 and the sealing plug 30 are integrally formed. With this configuration, the restriction part 321 of the pulling-out preventing member 32 interferes with or abuts against the sealing plug 30 so that the restriction part 321 restricts movement of the sealing plug 30 toward the second side of the part 310 to be sealed. In this case, the fitting part 322 of the pulling-out preventing member 32 may have a flange shape extending outward from the outer periphery of the sealing plug 30.

Figure 11:
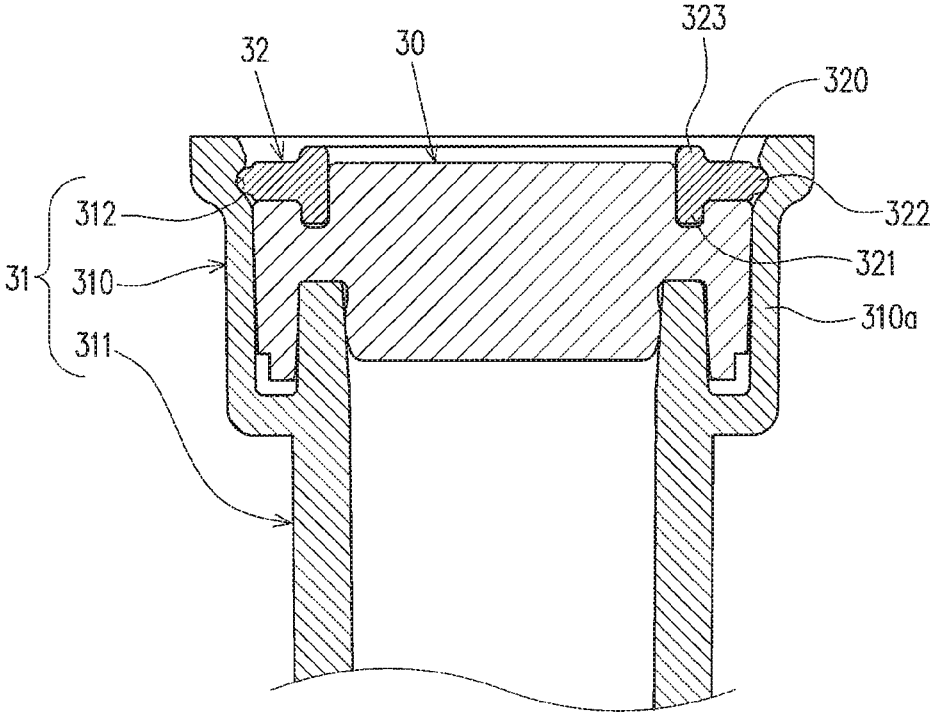
FIG. 11 is a longitudinal cross section of a part of a port according to yet another embodiment of the present invention.

In this embodiment, the entire area on the second surface side of the body part 320 has a flat surface shape, but this is not essential. For example, as shown in FIG. 11, the pulling-out preventing member 32 may include a projection part 323 that projects from the second surface of the body part 320.

In this case, it is preferable that the projection part 323 be disposed symmetrical to the restriction part 321 and have a shape symmetrical to the restriction part 321 with reference to a phantom line (phantom plane) orthogonal to a hole center of the body part 320 and passing through the body part 320.

With the above configuration, the pulling-out preventing member 32 has both sides thereof identical to each other, and therefore, when the pulling-out preventing member 32 is disposed within the part 310 to be sealed while the projection part 323 is directed toward the sealing plug 30, the projection part 323 functions as the restriction part 321. Accordingly, when assembling the port 3, it is not necessary to check on which side (a front side or back side) of the pulling-out preventing member 32 faces the right direction, which results in high productivity.

Figure 12:
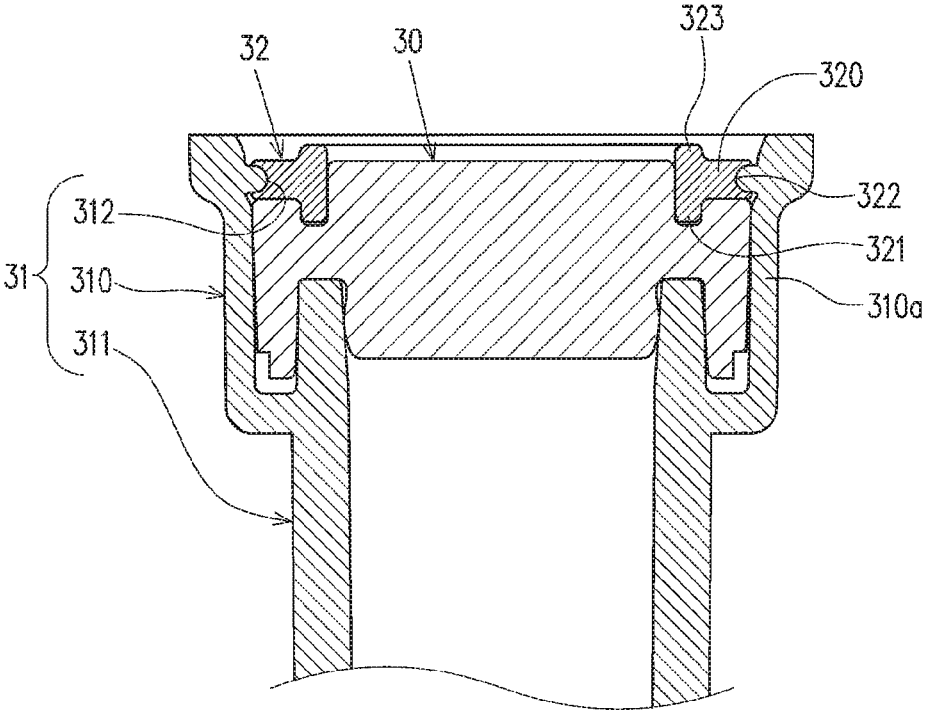
FIG. 12 is a longitudinal cross section of a part of a port according to another embodiment of the present invention.

In the above embodiment, the part 312 to be fitted is constituted by a recess part formed in the inner peripheral surface of the outer wall part 310*a*, but this is not essential. For example, as shown in FIG. 12, the part 312 to be fitted may be a projection part formed on the inner peripheral surface of the part 310 to be sealed (the outer wall part 310*a*). The part 312 to be fitted constituted by the projection part may extend on the inner peripheral surface of the outer wall part 310*a* continuously over the entire periphery in the circumferential direction. In this case, the fitting part 322 may be a recess part into which the projection part, which constitutes the part 312 to be fitted, can be fitted.

Although no specific remark was made in the above embodiment, in a case where the part 312 to be fitted is constituted by any one of the recess part and the projection part formed on the inner peripheral surface of the part 310 to be sealed (the outer wall part 310*a*), and the fitting part 322 is constituted by the remaining one of the recess part and the projection part, it is preferable that the projection part, which constitutes any one of the part 312 to be fitted and the fitting part 322, has a projection amount larger than the recess amount of the recess part. With this configuration, the projection part presses the opposite part, and therefore the pressure contact force between the part 312 to be fitted and the fitting part 322 is increased. Whereby, the pulling-out preventing member 32 is hardly removed from the part 310 to be sealed.

The projection amount of the projection part and the depth of the recess part may be set so that the projection part which constitutes any one of the part 312 to be fitted and the fitting part 322 has a fitting amount (overlapping amount) as large as possible with respect to the recess part which constitutes the remaining one of the part 312 to be fitted and the fitting part 322. With this configuration, the fitting part 322 and the part 312 to be fitted can be securely engaged with each other and hence the pulling-out preventing member 32 is hardly removed from the part 310 to be sealed.

Further, in order to prevent a third party's mischievous behavior or the like, a configuration of blocking forcible removal of the pulling-out preventing member 32 from the part 310 to be sealed may be provided to the port 3.

Figure 13:
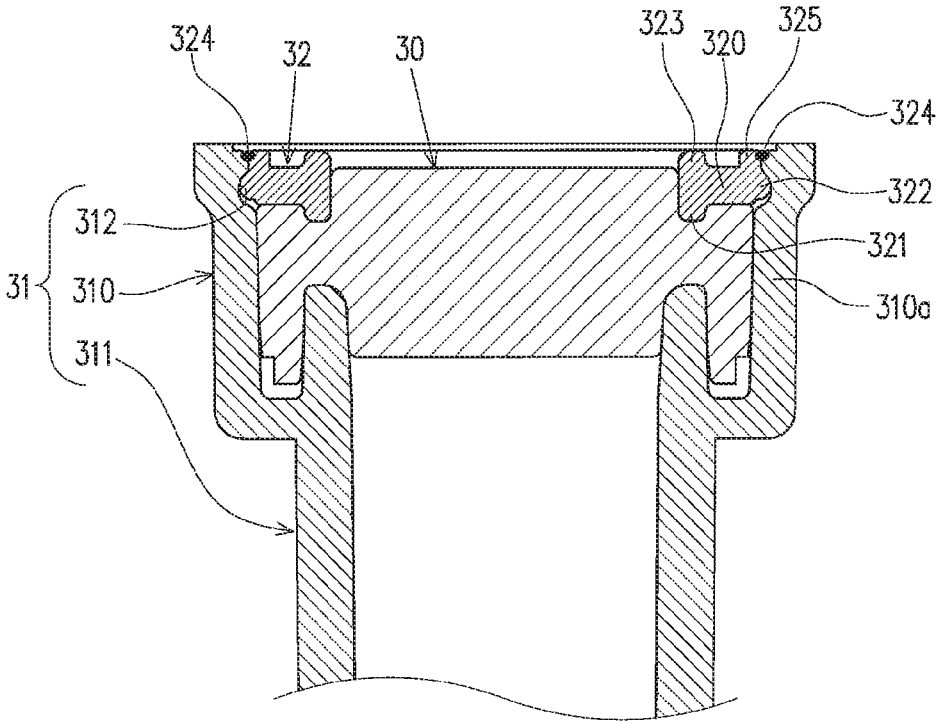
FIG. 13 is a longitudinal cross section of a part of a port according to still another embodiment of the present invention.

For example, as shown in FIG. 13, the port 3 may include a coupling part 324 formed by integrating at least a portion of the part 310 to be sealed and at least a portion of the pulling-out preventing member 32 disposed within the part 310 to be sealed.

In the above case, the pulling-out preventing member 32 and at least the part 310 to be sealed of the port body 31 are formed by a resin or resins which are compatible to each other and specifically can be mixed to each other in melted state. The pulling-out preventing member 32 includes a part 325 to be coupled having a surface being flush with any one of the inner peripheral surface, the outer peripheral surface and an end surface of the part 310 to be sealed (in FIG. 13, an end surface of the part 310 to be sealed) in a state where the pulling-out preventing member 32 is disposed within the part 310 to be sealed. The coupling part 324 is formed by melting and solidifying at least a portion of any one of the inner peripheral surface, the outer peripheral surface and the end surface of the part 310 to be sealed (in FIG. 13, the end surface of the part 310 to be sealed) with at least a portion of the surface of the part 325 to be coupled, which is flush therewith.

The above configuration makes the part 310 to be sealed integral with the pulling-out preventing member 32 fitted into the part 310 to be sealed, and therefore the removal of the pulling-out preventing member 32 is prevented.

Figure 14:
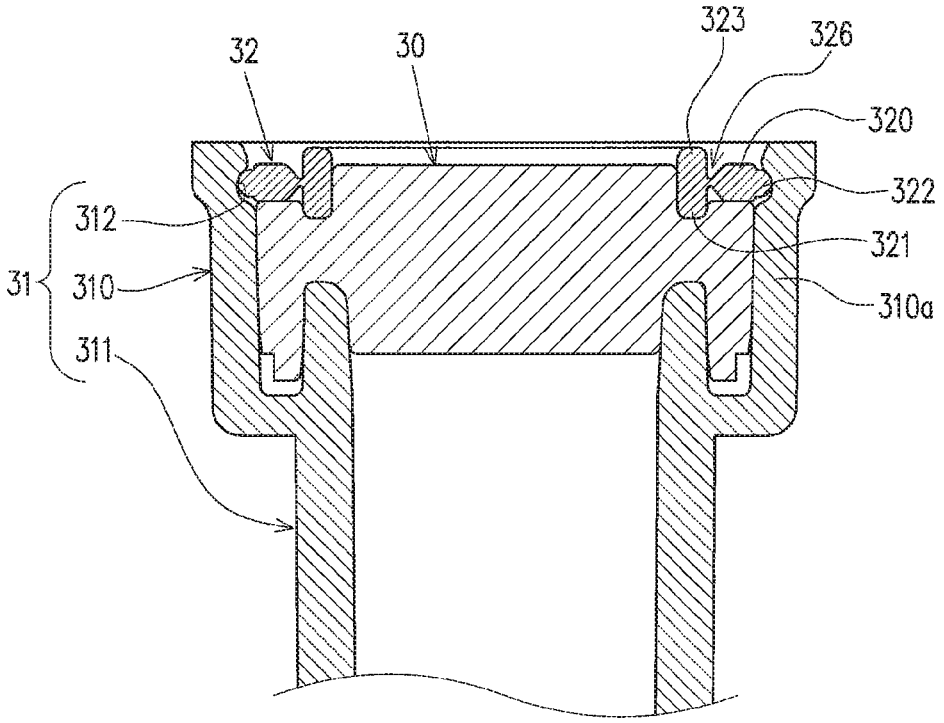
FIG. 14 is a longitudinal cross section of a part of a port according to yet another embodiment of the present invention.

As shown in FIG. 14, the pulling-out preventing member 32 may include a breaking part 326 for breaking the body part 320 along a boundary between the facing area of the first surface of the body part 320 and the area where the restriction part 321 is formed.

In the above case, the breaking part 326 is formed with a strength weaker than the other area of the body part 320 of the pulling-out preventing member 32. For example, the breaking part 326 is formed with a thickness thinner than the other area of the body part 320 of the pulling-out preventing member 32.

With the above configuration, in a case where a malicious third party attempts to remove the pulling-out preventing member 32 by, for example, pulling outward the projection 323 with a tool such as pliers, or forcing a tool or the like into the inner peripheral surface side of the body part 320 of the pulling-out preventing member 32, thereby applying a force onto the inner peripheral side of the body part 320 of the pulling-out preventing member 32, the pulling-out preventing member 32 breaks at the breaking part 326 having a weak strength.

Thus, the pulling-out preventing member 32 partially breaks, which indicates a sign of the third party's malicious behavior, so that the medical liquid bag 1 which may have been subjected to such a malicious behavior can be screened out in advance.

Figure 15:
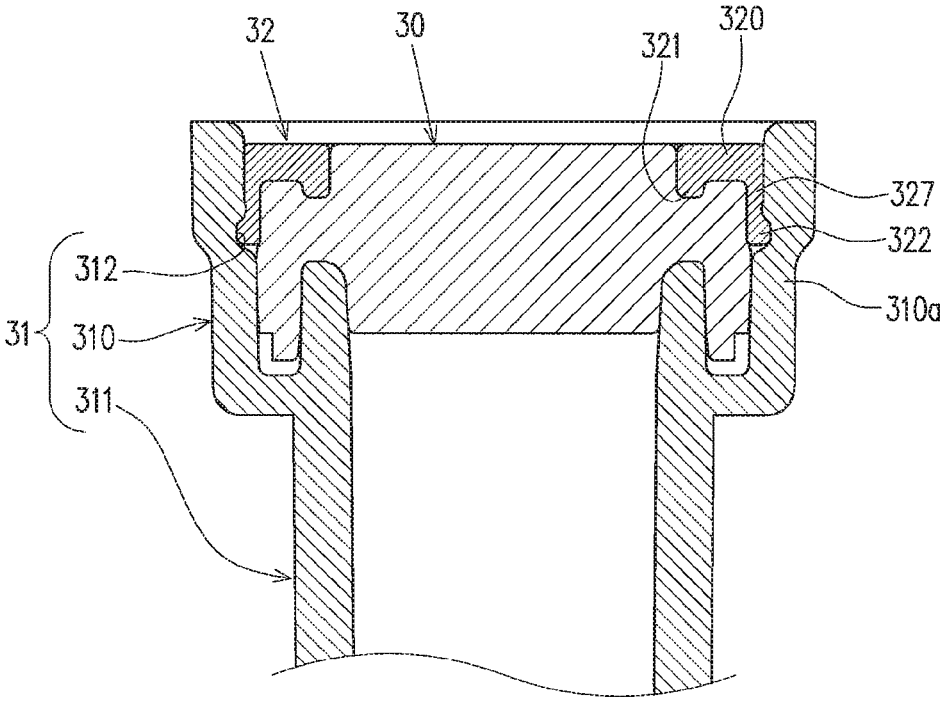
FIG. 15 is a longitudinal cross section of a part of a port according to another embodiment of the present invention.

Also, as shown in FIG. 15, the pulling-out preventing member 32 may include an extension part 327 that is disposed along the part 310 to be sealed (the outer wall part 310*a*), and has a proximal end and a distal end opposite to the proximal end in the center axis direction, in which the proximal end is connected to an outer peripheral end portion of the body part 320 of the pulling-out preventing member 32, and the fitting part 322 may include an extension part 327 that is connected to the distal end.

With the above configuration, the extension part 327 and the fitting part 322 connected to the distal end of the extension part 327 are held between the sealing plug 30 and the part 310 to be sealed (the outer wall part 310*a*). This configuration restricts the movement of the fitting part 322 in a direction in which it falls out of the part 312 to be fitted (the direction orthogonal to the center axis of the part 310 to be sealed).

Thus, even if a malicious third party attempts to remove the pulling-out preventing member 32, it is possible to prevent the fitting part 322 from being detached from the part 312 to be fitted.

That is, in a case where a malicious third party attempts to detach the pulling-out preventing member 32 by, for example, pulling outward the inner peripheral side of the body part 320 of the pulling-out preventing member 32 with a tool, or forcing a tool or the like into the inner peripheral surface side of the body part 320 of the pulling-out preventing member 32, thereby applying a force onto the inner peripheral side of the body part 320, an outer peripheral end or its proximal portion of the body part 320 of the pulling-out preventing member 32 acts as an operating point so that the fitting part 322 connected to the distal end of the extension part 327 is going to move in a direction in which the fitting part 322 connected to the distal end of the extension part 327 falls out of the part 312 to be fitted (the direction orthogonal to the center axis of the part 310 to be sealed).

However, as described above, the fitting part 322 is restricted from moving in a direction in which the fitting part 322 falls out of the part 312 to be fitted (the direction orthogonal to the center axis of the part 310 to be sealed), so that the fitting part 322 is blocked from being detached from the part 312 to be fitted.

The fitting part 322 connected to the distal end of the extension part 327 is disposed between the first end and the second end of the part 310 to be sealed (the outer wall part 310*a*) and disposed closer to the first end of the part 310 to be sealed than to the body part 320 of the pulling-out preventing member 32. That is, the fitting part 322 is disposed at a deep position within the part 310 to be sealed. With this configuration, direct access to the fitting part 322 is hardly made, and therefore it is possible to securely prevent a third party's mischievous behavior, such as detaching of the pulling-out preventing member 32 from the part 310 to be sealed.

In the above embodiment, the body part 320 of the pulling-out preventing member 32 has an annular shape with the center of the shape of the outer periphery coinciding with the center of the shape of the inner periphery, but this is not essential. For example, the body part 320 may have an annular shape with the center of the shape of the outer periphery not coinciding with the center of the shape of the inner periphery, or an annular shape with the shape of the outer periphery being different from the shape of the inner periphery. The body part 320 of the pulling-out preventing member 32 is not necessarily limited to an annular body part defining a through-hole. For example, the body part 320 of the pulling-out preventing member 32 may have a cut-out in place of the through-hole. That is, it is essential that the body part 320 of the pulling-out preventing member 32 has a needle insertion portion which allows the sealing plug 30 to be exposed outside and through which the hollow needle N is accessible to the sealing plug 30.

Figure 16:
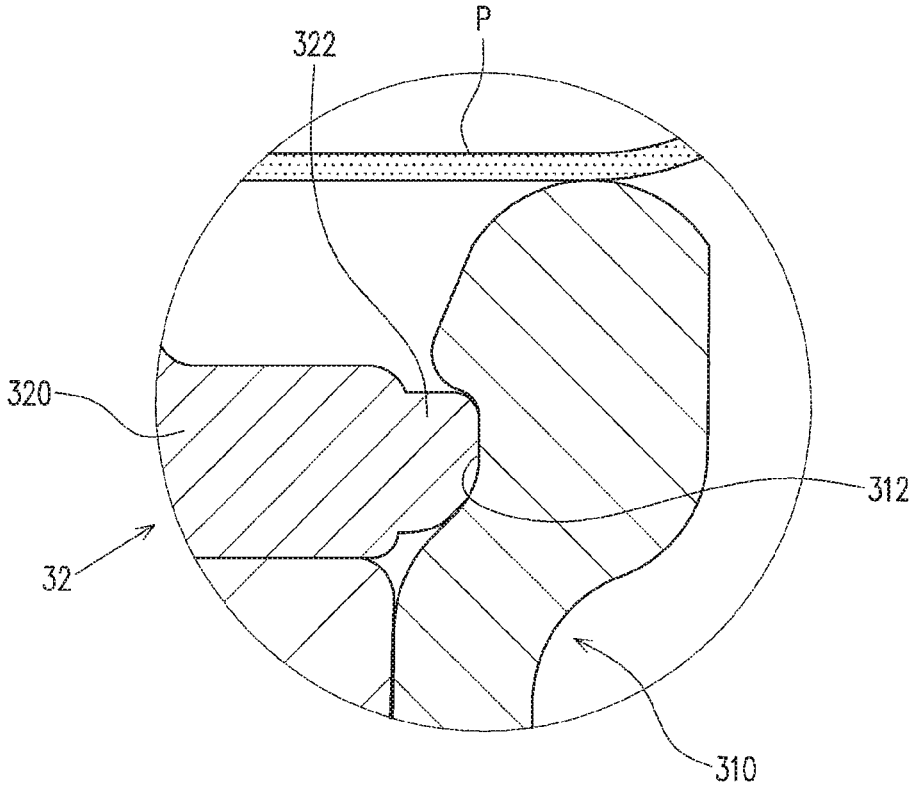
FIG. 16 is a longitudinal cross section of a part of a port according to yet another embodiment of the present invention.
Figure 17:
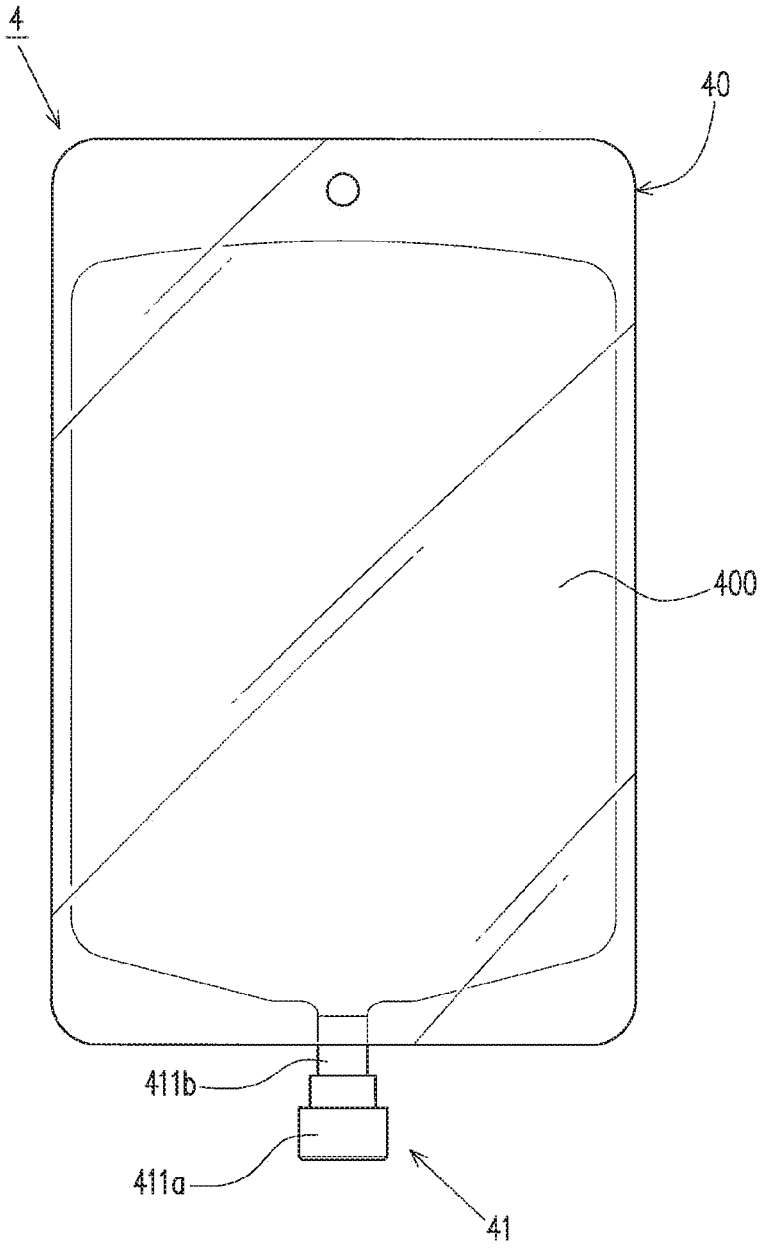
FIG. 17 is a front view of a conventional medical liquid bag.
Figure 18:
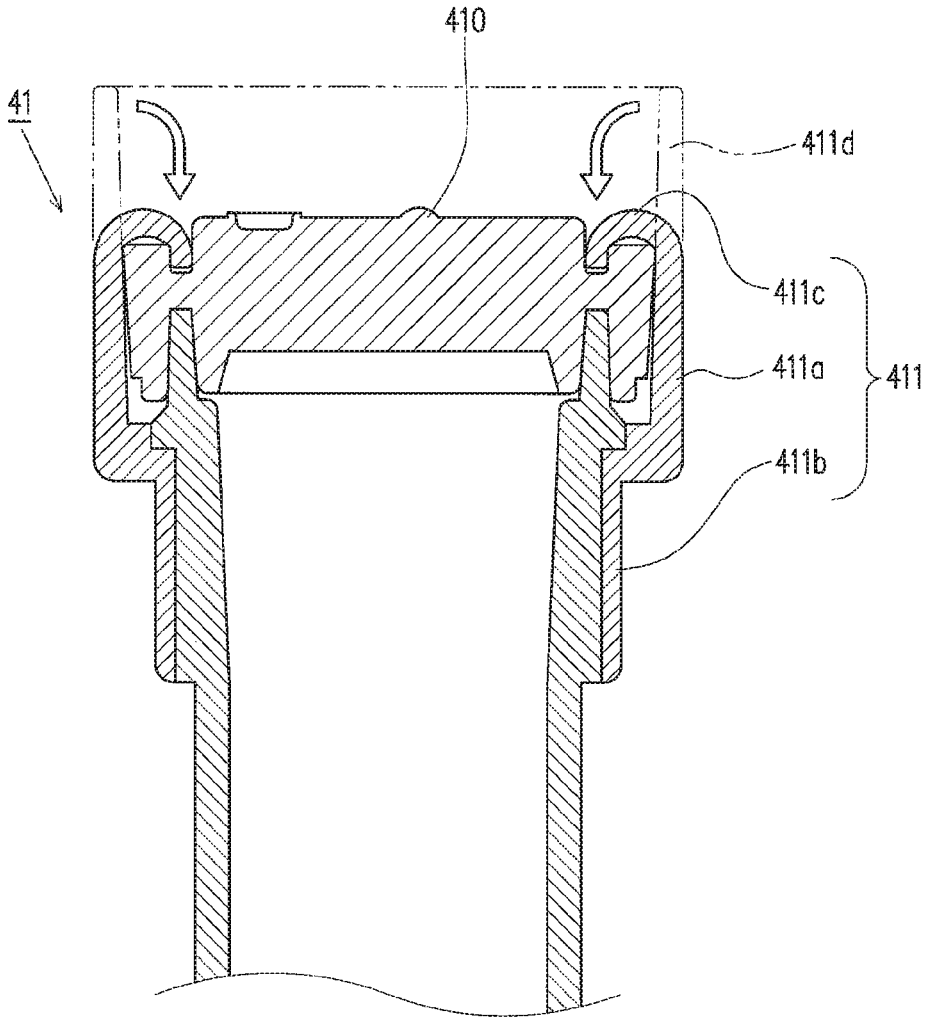
FIG. 18 is a longitudinal cross section of a conventional port.

In the above embodiment, the curvature of the part 312 to be fitted of the port body 31 is set to be smaller than the curvature of the outer peripheral surface of the fitting part 322. This is not essential. For example, as shown in FIG. 16, the curvature of the part 312 to be fitted of the port body 31 may be set to be equal or substantially equal to the curvature of the outer peripheral surface of the fitting part 322.

In the above embodiment, the entire periphery in the circumferential direction of the fitting part 322 of the pulling-out preventing member 32 comes into line contact with or into partial surface contact with the part 312 to be fitted, but this is not essential. For example, the fitting part 322 of the pulling-out preventing member 32 may partially come into contact with the part 312 to be fitted of the port body 31 through plural positions in the circumferential direction of the fitting part 322. That is, the part 312 to be fitted of the port body 31 and the fitting part 322 of the pulling-out preventing member 32 may be configured so as to come into contact with each other through plural positions (places) separated from each other in the circumferential direction.

The part 312 to be fitted and the fitting part 322 are not necessarily limited to the recess part or the projection part. The part 312 to be fitted and the fitting part 322 may be configured so as to be able to transmit a force which is directed in the center axis direction of the part 310 to be sealed, in the state where they are held in fitting engagement with each other. That is, on the premise that the part 312 to be fitted and the fitting part 322 can come into fitting engagement with each other, it may be configured so that the part 312 to be fitted has an engaging surface that has a flat contour or curved contour and is directed toward the one end side of the part 310 to be sealed, and the fitting part 322 has an engaging surface that has a flat contour or curved contour and is directed toward the second end side of the part 310 to be sealed and faces and comes into engagement with the engaging surface of the part 312 to be fitted.

Each of the above members or parts may be molded by using various conventional materials, such as polyethylene and polypropylene. Each of the above members or parts may be molded by a conventional technique such as injection molding.

DESCRIPTION OF THE REFERENCE NUMERALS

1: Medical liquid bag
2: Bag body
3: Port
20: Sheet member
21: Seal part
22: Storage chamber
22*a*: First storage chamber (space)
22*b*: Second storage chamber (space)
23: Weak seal part
30: Sealing plug
31: Port body
32: Pulling-out preventing member
300: Groove
301: Annular recess part
302: Extension
303: Annular projection part
310: Part to be sealed
310*a*: Outer wall part
310*b*: Continuous part
310*c*: Support part
311: Connection part
312: Part to be fitted
320: Body part
321: Restriction part
322: Fitting part
323: Projection part
324: Coupling part
325: Part to be coupled
326: Breaking part
327: Extension part
N: Hollow needle
P: Peelable seal

The invention claimed is:

1. A port comprising:

a sealing plug through which a hollow needle can be pierced;

a port body having a hollow structure with the sealing plug disposed therein; and a pulling-out preventing member to be attached to the port body;

the port body comprising:

a part to be sealed that has a tubular shape with a first end and a second end opposite to the first end in a center axis direction thereof, and is configured so that the sealing plug is sealingly inserted into the part to be sealed;

a connection part that has a tubular shape, is continuous with the first end of the part to be sealed, and has an outer periphery connected to a bag body to be filled with a medical liquid; and a part to be fitted that is formed in any one of an inner peripheral surface of the part to be sealed, an outer peripheral surface of the part to be sealed, and the second end of the part to be sealed;

the pulling-out preventing member comprising:

a body part that has a first surface directed toward the first end of the part to be sealed within the part to be sealed;

a restriction part that is formed on the first surface of the body part and restricts movement of the sealing plug toward the second end of the part to be sealed; and a fitting part that comes into fitting engagement with the part to be fitted of the port body, wherein the sealing plug has a first surface located on the pulling-out preventing member side extending the width of the sealing plug and a second surface located opposite to the first surface, the sealing plug having an extension and an annular projection part that surrounds an outer peripheral surface of the extension, the second surface being located between the extension and the projection part, the extension extending away from the second surface of the sealing plug, wherein the part to be sealed of the port body further has an outer wall part having a tubular shape and its end on the second end of the part to be sealed, a continuous part for connection between the outer wall part and the connection part, and a support part that has a tubular shape and extends from the continuous part toward the second end of the outer wall part, wherein the part to be fitted is formed in the inner peripheral surface of the outer wall part or in the second end of the outer wall part, wherein the support part of the part to be sealed is located inside of the wall part in a radial direction, and located between the outer peripheral surface of the extension and the annular projection part, wherein an outer peripheral surface of the extension bulges outward over the entire periphery in a circumferential direction on the annular projection part side, and wherein the part to be fitted and the fitting part engage with each other so as to be able to transmit a force which is directed in the center axis direction of the part to be sealed, in the state where the part to be fitted and the fitting part are held in fitting engagement with each other.

2. A port comprising:

a sealing plug through which a hollow needle can be pierced;

a port body having a hollow structure with the sealing plug disposed therein; and a pulling-out preventing member to be attached to the port body;

the port body comprising:

a part to be sealed that has a tubular shape with a first end and a second end opposite to the first end in a center axis direction thereof, and is configured so that the sealing plug is sealingly inserted into the part to be sealed;

a connection part that has a tubular shape, is continuous with the first end of the part to be sealed, and has an outer periphery connected to a bag body to be filled with a medical liquid; and a part to be fitted that is formed in any one of an inner peripheral surface of the part to be sealed, an outer peripheral surface of the part to be sealed, and the second end of the part to be sealed;

the pulling-out preventing member comprising:

a body part that has a first surface directed toward the first end of the part to be sealed within the part to be sealed;

a restriction part that is formed on the first surface of the body part and restricts movement of the sealing plug toward the second end of the part to be sealed; and a fitting part that comes into fitting engagement with the part to be fitted of the port body, wherein the sealing plug has a first surface located on the pulling-out preventing member side extending the width of the sealing plug and a second surface located opposite to the first surface, the sealing plug having an extension and an annular projection part that surrounds an outer peripheral surface of the extension, the second surface being located between the extension and the projection part, the extension extending away from the second surface of the sealing plug, wherein the part to be sealed of the port body further has an outer wall part having a tubular shape and its end on the second end of the part to be sealed, a continuous part for connection between the outer wall part and the connection part, and a support part that has a tubular shape and extends from the continuous part toward the second end of the outer wall part, wherein the part to be fitted is formed in the inner peripheral surface of the outer wall part or in the second end of the outer wall part, wherein the support part of the part to be sealed is located inside of the wall part in a radial direction, and located between the outer peripheral surface of the extension and the annular projection part, wherein an outer peripheral surface of the extension bulges outward over the entire periphery in a circumferential direction on the annular projection part side, wherein the part to be fitted has an engaging surface that is directed toward the one end side of the part to be sealed, and wherein the fitting part has an engaging surface that is directed toward the second end side of the part to be sealed and faces the engaging surface of the part to be fitted.

3. The port according to claim 1, wherein the part to be fitted is any one of a recess part and a projection part, and the fitting part is a remaining one of the recess part and the projection part.

4. The port according to claim 1, wherein the fitting part of the pulling-out preventing member comes into contact with a portion of the part to be fitted of the port body over the entire periphery in the circumferential direction of the fitting part or through plural places of the periphery in the circumferential direction of the fitting part.

5. The port according to claim 1, wherein the sealing plug has a groove formed on a surface opposite to the pulling-out preventing member, and the restriction part of the pulling-out preventing member projects into the groove from the first surface of the body part.

6. A medical liquid bag comprising:

the bag body, the inside of which is filled with a medical liquid; and the port according to claim 1, wherein the port includes the connection part that is connected to the bag body.

7. The port according to claim 2, wherein the part to be fitted is any one of a recess part and a projection part, and the fitting part is a remaining one of the recess part and the projection part.

8. The port according to claim 2, wherein the fitting part of the pulling-out preventing member comes into contact with a portion of the part to be fitted of the port body over the entire periphery in the circumferential direction of the fitting part or through plural places of the periphery in the circumferential direction of the fitting part.

9. The port according to claim 2, wherein the sealing plug has a groove formed on a surface opposite to the pulling-out preventing member, and the restriction part of the pulling-out preventing member projects into the groove from the first surface of the body part.

10. A medical liquid bag comprising:

the bag body, the inside of which is filled with a medical liquid; and the port according to claim 2, wherein the port includes the connection part that is connected to the bag body.

* * * * *